US007334380B2

(12) United States Patent
Brunee

(10) Patent No.: US 7,334,380 B2
(45) Date of Patent: Feb. 26, 2008

(54) DEVICE FOR SCREWING CAPS ONTO RECEPTACLES

(75) Inventor: Jacky Brunee, Kuala Lumpur (MY)

(73) Assignee: Serac Group, La Ferte Bernard (FR)

( * ) Notice: Subject to any disclaimer, the term of this patent is extended or adjusted under 35 U.S.C. 154(b) by 0 days.

(21) Appl. No.: 11/435,711

(22) Filed: May 18, 2006

(65) Prior Publication Data

US 2006/0260277 A1 Nov. 23, 2006

(30) Foreign Application Priority Data

May 19, 2005 (FR) ..... 05 05019

(51) Int. Cl.
*B65B 7/28* (2006.01)
*B67B 3/20* (2006.01)

(52) U.S. Cl. ..... 53/317; 53/331.5; 53/343

(58) Field of Classification Search ..... 53/317, 53/331.5, 343, 490; 464/29
See application file for complete search history.

(56) References Cited

U.S. PATENT DOCUMENTS 4,485,609 A * 12/1984 Kowal ..... 53/331.5
4,492,068 A * 1/1985 Obrist ..... 53/331.5
4,599,846 A * 7/1986 Ellis et al. ..... 53/331.5
4,674,264 A * 6/1987 Ellis et al. ..... 53/331.5
5,197,258 A * 3/1993 Johanek ..... 53/317
5,313,765 A * 5/1994 Martin ..... 53/317
5,437,139 A * 8/1995 Martin ..... 53/317
5,490,369 A * 2/1996 Ellis et al. ..... 53/317
5,584,161 A * 12/1996 Zanini et al. ..... 53/317
5,714,820 A * 2/1998 Mitsuhashi et al. ..... 53/317
5,809,742 A * 9/1998 Takakusaki et al. ..... 53/317
5,996,311 A 12/1999 Heard et al.
6,041,571 A * 3/2000 Fields et al. ..... 53/331.5
6,240,678 B1 * 6/2001 Spether ..... 53/317
6,871,482 B2 * 3/2005 Cirio ..... 53/317
6,941,724 B2 * 9/2005 Arrant et al. ..... 53/343
7,124,552 B2 * 10/2006 Lang ..... 53/331.5
7,181,892 B1 * 2/2007 Scott et al. ..... 53/331.5
2002/0184583 A1 12/2002 Arrant et al.
2003/0154688 A1 8/2003 Lang

FOREIGN PATENT DOCUMENTS

FR 2 724 430 A1 3/1996

* cited by examiner

*Primary Examiner*—Louis Huynh
(74) *Attorney, Agent, or Firm*—Birch, Stewart, Kolasch & Birch, LLP

(57) ABSTRACT

A device for screwing caps onto receptacles, the device comprising a rotary spindle having a first end provided with a cap gripper head and a second end connected to a two-portion clutch member, one of which portions is constrained to rotate with the second end of the rotary spindle, and the other of which portions is constrained to rotate with a drive shaft on the same axis as the spindle and associated with a drive member, wherein the portions of the clutch member comprise a magnetic bell and a magnetic core having dimensions suitable for enabling it to be engaged in the bell, the device further comprising a displacement member for displacing the bell and the core relative to each other between a position in which the core is engaged in the bell and a position in which the core is disengaged from the bell.

3 Claims, 3 Drawing Sheets

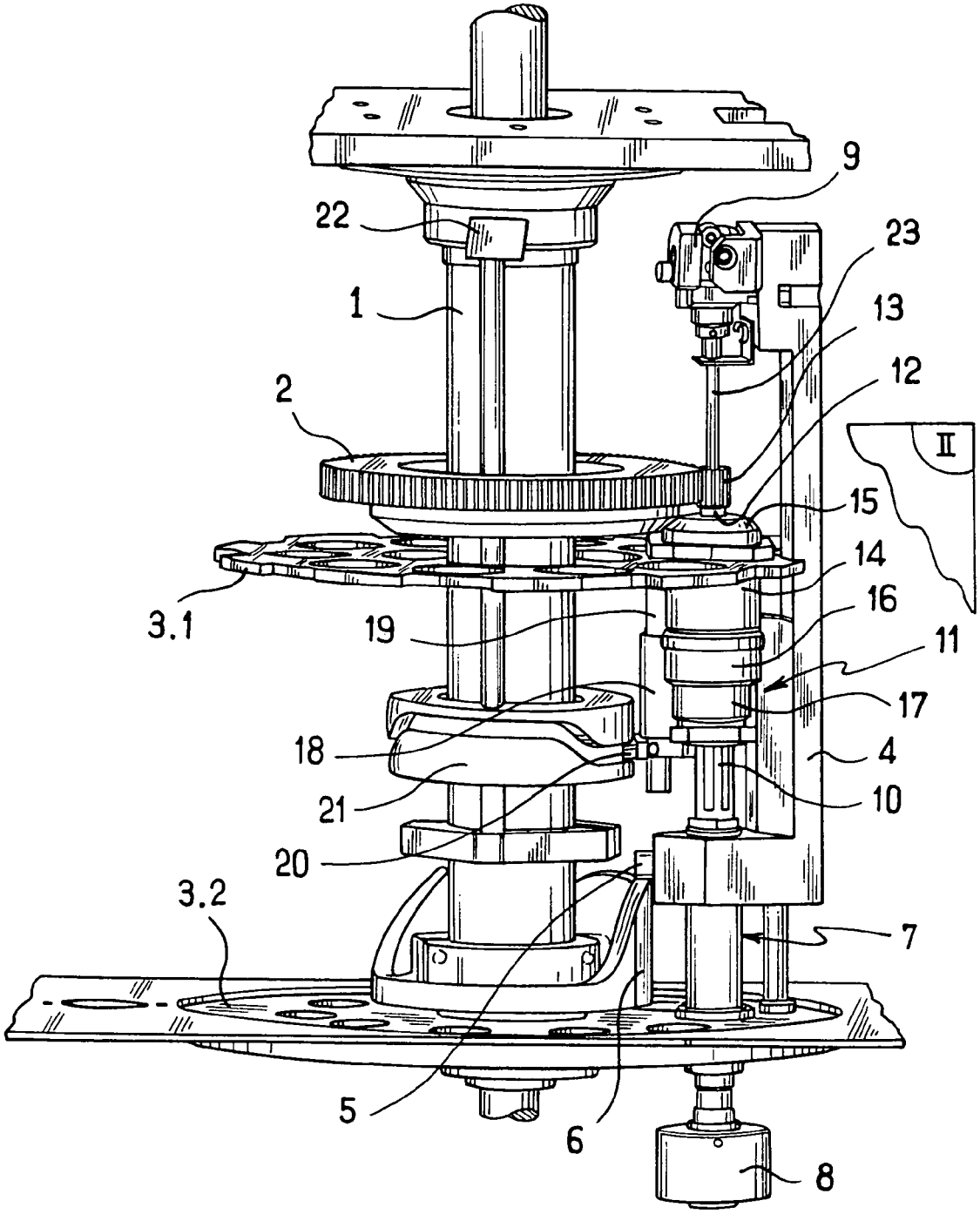
FIG_1
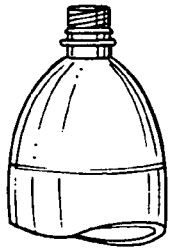

DEVICE FOR SCREWING CAPS ONTO RECEPTACLES

The present invention relates to a device for screwing caps onto receptacles.

BACKGROUND OF THE INVENTION

A device for screwing on caps generally comprises a stationary structure, a platform mounted to pivot on the stationary structure, and rotary spindles mounted on the platform. Each rotary spindle has a first end provided with a head for gripping caps, and a second end connected via a torque limiter to a drive shaft having a gearwheel meshing with a toothed wheel secured to the stationary structure. There exist magnetic torque limiters comprising a magnetic bell constrained to rotate with the drive shaft and a magnetized magnetic core constrained to rotate with the spindle and slidably received in the bell so that the bell and the core are coupled together magnetically. The depth to which the core is engaged in the bell determines the maximum torque that can be transmitted from the bell to the core, and thus the tightening torque. At the end of screw tightening, the gripping head is opened to release the closed receptacle. When the clamp opens, it starts turning again. Opening the clamp while torque is being exerted thereon thus runs the risks of scratching the cap and of wearing the clamp prematurely. In order to remedy that drawback, it is necessary also to provide a clutch to enable the spindle to be decoupled from the drive shaft.

OBJECT OF THE INVENTION

An object of the invention is to provide means that are simple and inexpensive for adjusting the clamping torque of caps and for stopping rotation of the spindle.

BRIEF SUMMARY OF THE INVENTION

To this end, the invention provides a device for screwing caps onto receptacles, the device comprising a rotary spindle having a first end provided with a cap-gripper head and a second end connected to a two-portion clutch member, one of which portions is constrained to rotate with the second end of the rotary spindle, and the other of which portions is constrained to rotate with a drive shaft on the same axis as the spindle and associated with a drive member, the portions of the clutch member comprising a magnetic bell and a magnetic core having dimensions suitable for enabling it to be engaged in the bell, the device further comprising a displacement member for displacing the bell and the core relative to each other between a position in which the core is engaged in the bell and a position in which the core is disengaged from the bell.

Thus, when the core is engaged fully in the bell, it ensures that a maximum amount of torque is transmitted between the bell and the core. The drive shaft then turns the rotary spindle with maximum torque. When the core is disengaged from the bell, the core and the bell are free to turn relative to each other. The rotary spindle is then not driven by the drive shaft. In addition, it is possible to modify the torque transmitted between the bell and the core by modifying the extent to which the core is engaged in the bell. The clutch member thus also performs a torque-limiter function.

The core is preferably mounted to slide on the second end of the spindle, and the spindle is advantageously mounted on a turning platform secured to a structure on which there is secured a cam that co-operates with a wheel mounted on a slider for supporting the core so as to form the core-displacement member.

The structure of the device, and more particularly of the displacement member, is thus particularly simple.

Also advantageously, the device includes means for adjusting the height of the cam relative to the structure.

Changing the height adjustment of the cam relative to the structure serves to modify the depth to which the core is engaged in the bell. It is thus possible to adjust the tightening torque, i.e. the maximum value of the torque that can be transmitted between the bell and the core. This is particularly advantageous when a plurality of rotary spindles are mounted on the platform, since a single action adjusting the height of the cam serves to modify the value of the tightening torque for all of the spindles.

Other characteristics and advantages of the invention appear on reading the following description of a particular, non-limiting embodiment of the invention.

BRIEF DESCRIPTION OF THE DRAWINGS

Reference is made to the accompanying drawings, in which:

FIG. 1 is a fragmentary perspective view of a cap-tightener device in accordance with the invention at the beginning of a tightening cycle;

DETAILED DESCRIPTION OF THE INVENTION

Figure 2:
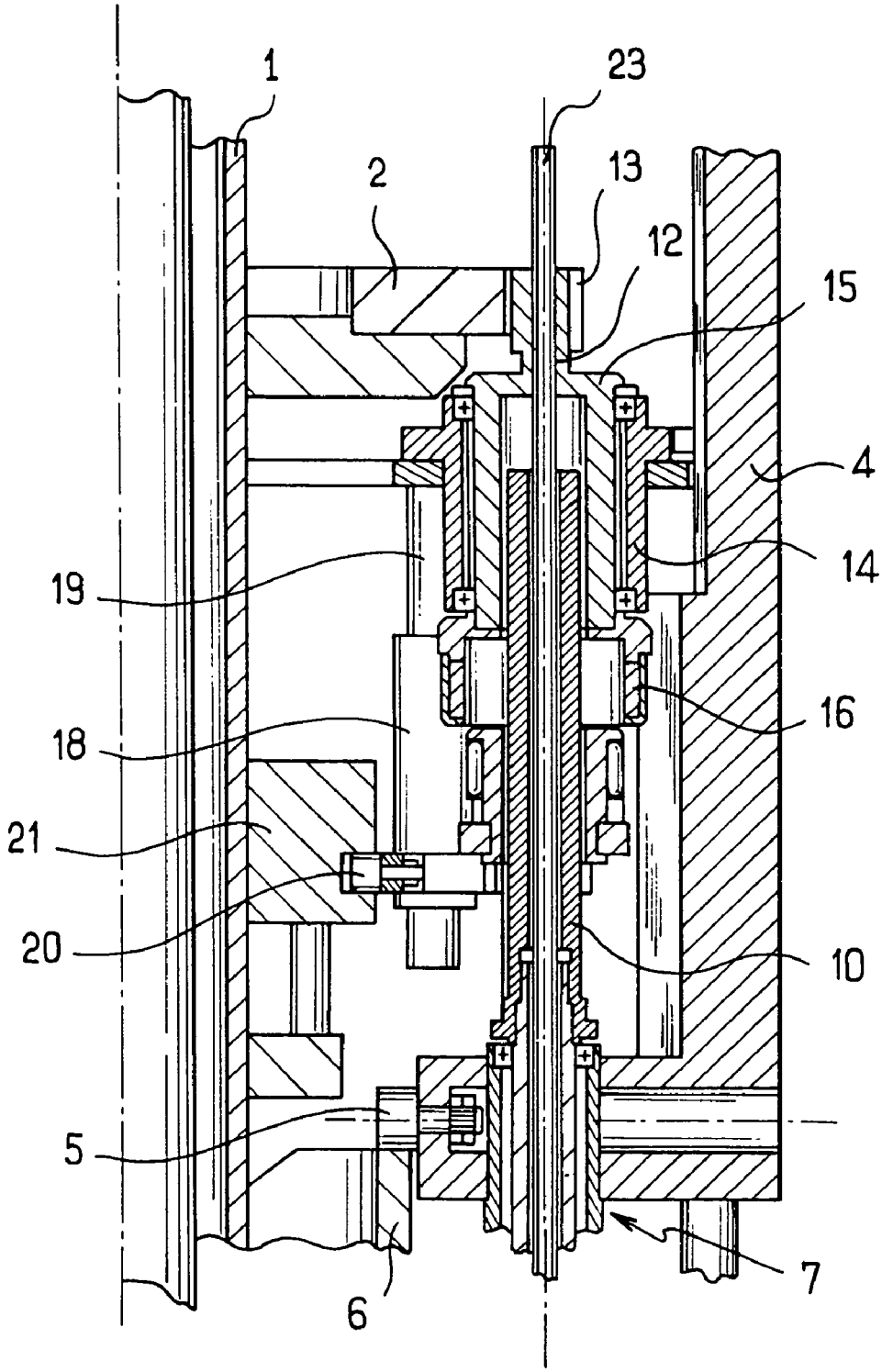
FIG. 2 is a fragmentary section view on plane II of FIG. 1.

The cap-tightener device in accordance with the invention comprises a stationary structure 1 having a tube provided with a stationary toothed ring 2, and a platform 3 mounted on the stationary structure 1 to turn about the toothed ring 2. The platform 3 is driven by a drive shaft turning in the tube of the stationary structure 1 and it comprises two plates, namely a top plate 3.1 and a bottom plate 3.2 that are parallel and that are held spaced apart from each other by spacer-forming columns (not shown in the figures).

The platform 3 is fitted with vertical support elements 4 mounted in conventional manner to slide parallel to the axis of rotation of the platform 3. Each support element 4 is fitted with a wheel 5 running on a cam 6 that is stationary relative to the structure 1 and disposed coaxially about the axis of the platform 3 so as to move the support element 4 between a high, rest position (shown in FIG. 1) and a low, end-of-tightening position (shown in FIG. 3).

Tightener spindles, given general reference 7, are mounted to rotate on the bottom ends of respective support elements 4 (only one spindle is visible in the figures). Each tightener spindle 7 is tubular in shape and possesses a bottom end provided with a gripper head 8, in this example a clamp, that is associated in conventional manner with an actuator member 9 secured to a top end of the support element 4 and connected to the gripper head 8 by a control rod 23. Each tightener spindle 7 has a top end constituted by a fluted segment 10 connected via a clutch member, given overall reference 11, to a drive shaft 12 provided with a gearwheel 13 meshing with the toothed ring 2.

Figure 3:
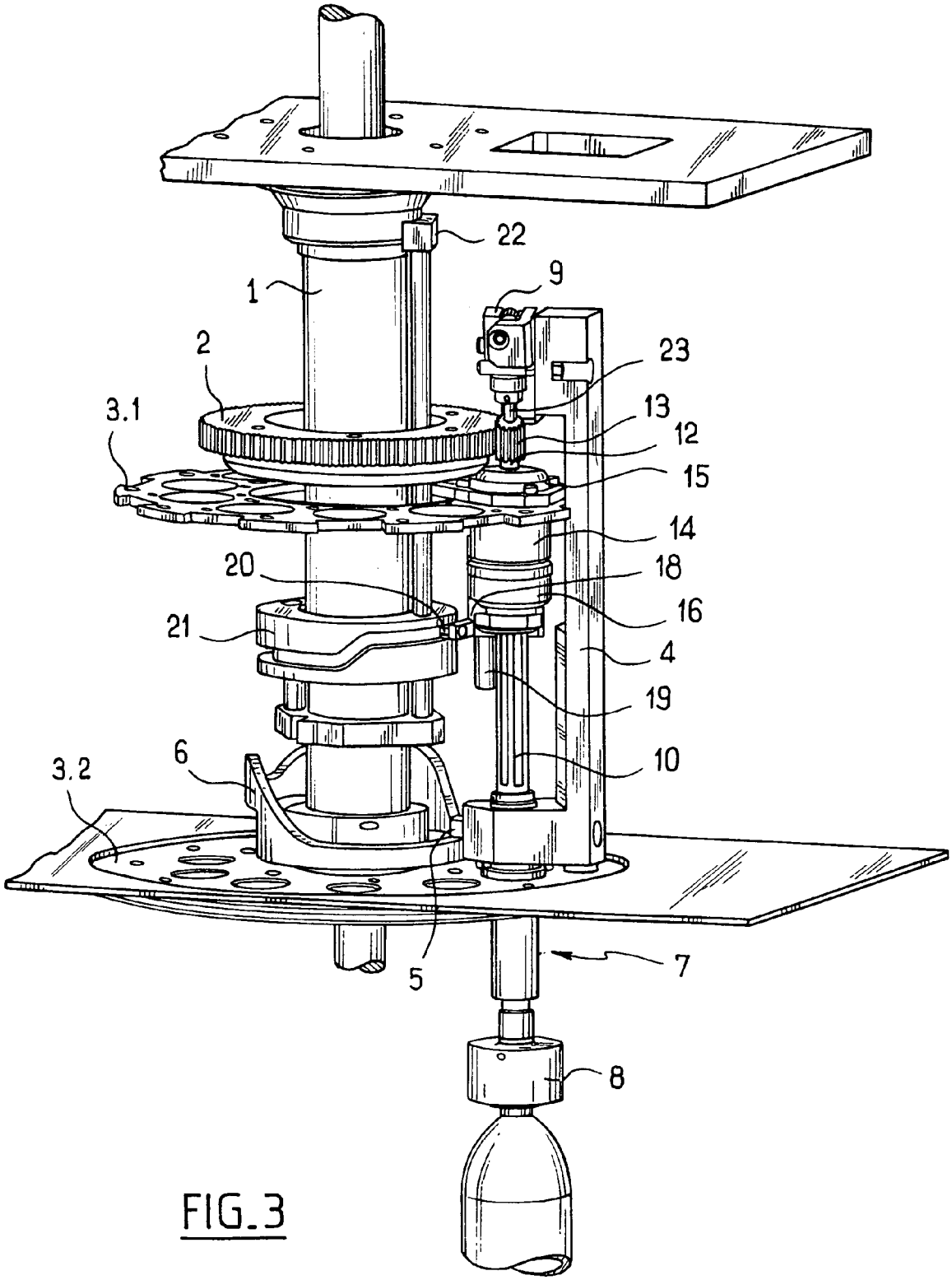
FIG. 3 is a fragmentary perspective view of the cap-tightener device at the end of its operation, at the moment the cap is screwed on tight.

The clutch member 11 comprises two portions. One of the portions is a bell 14 rotatably received by the top plate 3.1 and possessing an end wall 15 secured to the drive shaft 12, and at its opposite end a tubular magnetic portion 16. The fluted segment 10 is freely received in the bell 14. The other portion of the clutch is a magnetized magnetic core 17 of dimensions suitable for enabling it to be engaged in the magnetic portion 16 and which is slidably received on the fluted segment 10 of the tightener spindle 7. The magnetic core 17 is secured to a slider 18 mounted on a vertical guide 19 secured under the top plate 3.1. A wheel 20 is secured to the slider 18 so as to co-operate with a cam 21 that is prevented from turning relative to the stationary structure 1 and that is disposed coaxially about the axis of the platform 3. The cam 21 is arranged to move the slider 18, and thus the magnetic core 17 between a position as shown in FIG. 3 in which the magnetic core 17 is engaged in the magnetic portion 16 of the bell 14, and a position as shown in FIG. 1 in which the magnetic core 17 is disengaged from the magnetic portion 16. The cam 21 is movable in translation along the stationary structure 1 and the position of the cam 21 along the structure 1 can be adjusted by means of a displacement member, represented diagrammatically at 22, such as an electromagnetic actuator or a jack for adjusting the depth to which the magnetic core 17 is engaged in the magnetic portion 16. The torque that can be transmitted from the magnetic portion 16 to the magnetic core 17, i.e. the tightening torque, depends on the depth to which the magnetic core 17 is engaged in the magnetic portion 16, such that the displacement member 22 serves to adjust the tightening torque. In the disengaged position, the core 17 is outside the bell 14 and no torque can be transmitted between the core 17 and the bell 14.

There follows a description of a cap-tightening cycle of a spindle 7.

The platform 3 is rotating relative to the stationary structure 1 and the drive shaft 12 is driven in rotation by the gearwheel 13 meshing with the toothed ring 2.

The magnetic core 17 is in the position where it is disengaged from the magnetic portion 16, the spindle is stationary, and the gripper head 8 takes hold of a cap in a cap feeder member that is not shown (FIGS. 1 and 2). A receptacle is then brought under the tightener spindle 7.

As the platform 3 continues to rotate, the cam 21 causes the wheel 20 to move upwards, thereby causing the magnetic core 17 to be engaged in the magnetic portion 16 of the bell 14. With the magnetic core 17 engaged in the magnetic portion 16, the magnetic core 17 and the magnetic portion 16 are coupled together magnetically so the rotary movement of the drive shaft 12 is communicated to the tightener spindle 7. The cam 6 then causes the tightener spindle 7 to move down so as to engage the cap on the neck of the receptacle.

When the cap reaches the neck, the cam 21 brings the magnetic core 17 into the disengaged position such that the rotary movement of the tightener spindle 7 is a result solely of its inertia. Thus, during the stage in which the cap is being screwed onto the neck, the tightener spindle 7 is rotating freely. The spindle 7 stops when its kinetic energy is no longer sufficient to overcome the torque opposing screw-tightening of the cap.

The cam 21 brings the magnetic core 17 into the position where it is engaged in the magnetic portion 16 by an amount that corresponds to the tightening torque that is desired to obtain (FIG. 3). When the level of torque opposing screw-tightening reaches the tightening torque, the tightener spindle 7 stops, even though the drive shaft 12 continues to turn.

The cam 21 brings the magnetic core 17 into the disengaged position in order to decouple the magnetic core 17 from the magnetic portion 16 before the actuator member 9 causes the gripper head 8 to open, so that when the jaws are opened no torque is being applied to the tightener spindle 7. The cam 6 then causes the tightener spindle 7 to rise into the high position.

It should be observed that the kinetic energy of the tightener spindle 7 during tightening may be at a level such as to ensure that it cannot generate torque greater than the desired tightening toque. In the event of a high degree of friction between the cap and the neck, and if the kinetic energy of the tightener spindle is not sufficient on its own to overcome this friction, it is possible to maintain the magnetic core 17 engaged to a small extent in the magnetic portion 16 in order to transmit some minimal level of torque that suffices to enable the cap to be screwed on.

Naturally, the invention is not restricted to the embodiment described and variant embodiments can be provided without going beyond the ambit of the invention as defined by the claims.

In particular, the invention can be obtained by inverting the configuration of the embodiment described.

The cam 21 can be manually adjustable in position on the structure 1, e.g. by means of a clamping collar, or it need not be adjustable at all.

The up and down movements of the tightener spindle and/of the magnetic core can be obtained by means of electrical actuators or jacks, or possibly by using a rack system.

What is claimed is:

1. A device for screwing caps onto receptacles, the device comprising a rotary spindle having a first end provided with a cap gripper head and a second end connected to a two-portion clutch member, one of which portions is constrained to rotate with the second end of the rotary spindle, and the other of which portions is constrained to rotate with a drive shaft on the same axis as the spindle and associated with a drive member, wherein the portions of the clutch member comprise a magnetic bell and a magnetic core having dimensions suitable for enabling it to be engaged in the bell, the device further comprising a displacement member for displacing the bell and the core relative to each other between a position in which the core is engaged in the bell and a position in which the core is disengaged from the bell, wherein the core is mounted to slide on the second end of the spindle, and wherein the spindle is mounted on a rotary platform secured to a structure having a cam secured thereto that co-operates with a wheel mourned on a slider of the core so as to form the displacement member.

2. The device according to claim 1, further including means for adjusting the height of the cam relative to the structure.

3. The device according to claim 1, wherein the spindle is fitted on a support element mounted on the structure to slide, the structure having a cam secured thereto that cooperates with the support element so as to move the spindle between a rest position and an end-of-tightening position.

* * * * *